US008306463B2

(12) United States Patent
Liu et al.

(10) Patent No.: US 8,306,463 B2
(45) Date of Patent: Nov. 6, 2012

(54) TONER CARTRIDGE WITH ROTATOR AND SLIDING COVER FOR TONER LEAKAGE REDUCTION

(75) Inventors: Ren-Hao Liu, Taichung (TW); Ming-Tsung Shih, Changhua County (TW); Shao-Yuan Tsai, Taichung County (TW)

(73) Assignee: General Plastic Industrial Co., Ltd., Wu-Chi Town, Taichung County (TW)

( * ) Notice: Subject to any disclaimer, the term of this patent is extended or adjusted under 35 U.S.C. 154(b) by 333 days.

(21) Appl. No.: 12/857,044

(22) Filed: Aug. 16, 2010

(65) Prior Publication Data

US 2012/0039635 A1 Feb. 16, 2012

(51) Int. Cl.
*G03G 15/08* (2006.01)

(52) U.S. Cl. ..... 399/262; 399/258

(58) Field of Classification Search ..... 399/120, 399/262

See application file for complete search history.

(56) References Cited

U.S. PATENT DOCUMENTS

| | | | | |
|---|---|---|---|---|
| 7,729,645 | B2 * | 6/2010 | Noguchi | 399/262 |
| 2008/0124119 | A1 * | 5/2008 | Oda | 399/120 |
| 2010/0178080 | A1 * | 7/2010 | Huang | 399/262 |

FOREIGN PATENT DOCUMENTS

JP 2009230150 A * 10/2009

* cited by examiner

*Primary Examiner* — David Gray
*Assistant Examiner* — Tyler Hardman
(74) *Attorney, Agent, or Firm* — Muncy, Geissler, Olds & Lowe, PLLC

(57) ABSTRACT

A toner cartridge includes a housing having a first mouth and a second mouth, a rotator having a first opening and a second opening and being rotatably mounted on the housing in such a manner that the first and second mouths are accessible through the first and second openings respectively, and a sliding cover having a through hole and being slidably disposed on the housing in such a manner that the second mouth is closeable by the sliding cover. When the rotator is erroneously forced to rotate relative to the housing, the first mouth of the housing exposes outside through the first opening of the rotator and the second mouth of the housing will be covered by the sliding cover. Therefore, the leakage of the toner caused by a user's erroneous operation of the toner cartridge of the present invention can be effectively reduced.

6 Claims, 7 Drawing Sheets

TONER CARTRIDGE WITH ROTATOR AND SLIDING COVER FOR TONER LEAKAGE REDUCTION

BACKGROUND OF THE INVENTION

1. Field of the Invention

The present invention relates generally to a toner cartridge and more specifically, to a toner cartridge which can reduce the leakage of toner caused by a user's erroneous operation.

2. Description of the Related Art

A conventional toner cartridge for an image forming apparatus generally includes a feed outlet for discharging toner from the toner cartridge to the image forming apparatus, and a return inlet for recycling surplus toner from the image forming apparatus to the toner cartridge.

FIG. 1 and FIG. 2 illustrate a conventional toner cartridge 10 which comprises a housing 12 for accommodation of toner having a feed outlet 122 and a return inlet 124, a rotator 14 mounted on one end of the housing 12 and provided with a first opening 142 and a second opening 144, and a pad 16 disposed between the housing 12 and the rotator 14 and surrounding the feed outlet 122 and the return inlet 124. The rotator 14 is rotatable relative to the housing 12 between an open position P1 where the feed outlet 122 and the return inlet 124 are open and a closed position P2 where the feed outlet 122 and the return inlet 124 are closed.

When the conventional toner cartridge 10 isn't installed in an image forming apparatus, the rotator 14 is located at the closed position P2. When the toner cartridge 10 is installed in an image forming apparatus, the installation action will drive the rotator 14 to rotate relative to the housing 12 from the closed position P2 to the open position P1, such that the feed outlet 122 and the return inlet 124 of the toner cartridge 10 are accessible through the first opening 142 and the second opening 144 of the rotator 14 respectively for discharging toner and recycling surplus toner.

As stated above, the feed outlet 122 and the return inlet 124 of the toner cartridge 10 will be accessible simultaneously when the rotator 14 is rotated from the closed position P2 to the open position P1. Thus, when the toner cartridge 10 isn't installed in an image forming apparatus and the rotator 14 is forced by a user's erroneous operation to rotate from the closed position P2 to the open position P1, the toner will leak from the feed outlet 122 and the return inlet 124 concurrently, resulting in that toner is wasted massively and undesirably.

Besides, since the rotator 14 is made by plastic injection molding, the inner wall of the rotator 14 has a certain draft taper, such that the space between the rotator 14 and the housing 12 gradually increases along the axis of the rotator 14. Because the space between the rotator 14 and the housing 12 cannot be fully filled by the pad 16, which has a uniform thickness and is disposed between the housing 12 and the rotator 14 of the conventional toner cartridge 10 and surrounds the feed outlet 122 and the return inlet 124, the toner may leak out of the cartridge 10.

SUMMARY OF THE INVENTION

The present invention is accomplished in view of the above-noted circumstances. The primary objective of the present invention is to provide a toner cartridge, which can reduce the leakage of toner caused by a user's erroneous operation.

It is another objective of the present invention to provide a toner cartridge, which can prevent leak of toner while the toner cartridge is in normal use.

In order to achieve the aforesaid objectives, the toner cartridge of the present invention comprises a housing, a rotator rotatably mounted on the housing, and a sliding cover slidably disposed on the housing. The housing has a first mouth and a second mouth. The rotator has a first opening and a second opening and is rotatable relative to the housing between a first position and a second position. When the rotator is rotated to the first position, the first mouth of the housing is closed by the rotator and the second mouth of the housing is accessible through the second opening of the rotator. When the rotator is rotated to the second position, the first mouth of the housing is accessible through the first opening of the rotator and the second mouth of the housing is accessible through the second opening of the rotator. The sliding cover has a through hole and is received in the second opening of the rotator. The sliding cover is slidably moveable relative to the housing between a closed position where the second mouth is closed by the sliding cover, and an open position where the second mouth is accessible through the through hole of the sliding cover and the second opening of the rotator. In addition, when the rotator is located at the first position, the sliding cover is stayed at the closed position, and when the rotator is located at the second position, the sliding cover is moveable from the closed position to the open position by an external force.

As a result, when the toner cartridge of the present invention isn't installed in an image forming apparatus, the first and second mouths of the housing are closed, such that toner will not leak out of the housing. Besides, when the rotator of the toner cartridge of the present invention is forced to rotate relative to the housing by a user's erroneous operation, only the first mouth of the housing will be accessible through the first opening of the rotator and the second mouth of the housing will still be closed by the sliding cover that is stayed at the closed position, resulting in that toner will leak out of the housing only through the first mouth, thereby effectively reducing the leakage of toner.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
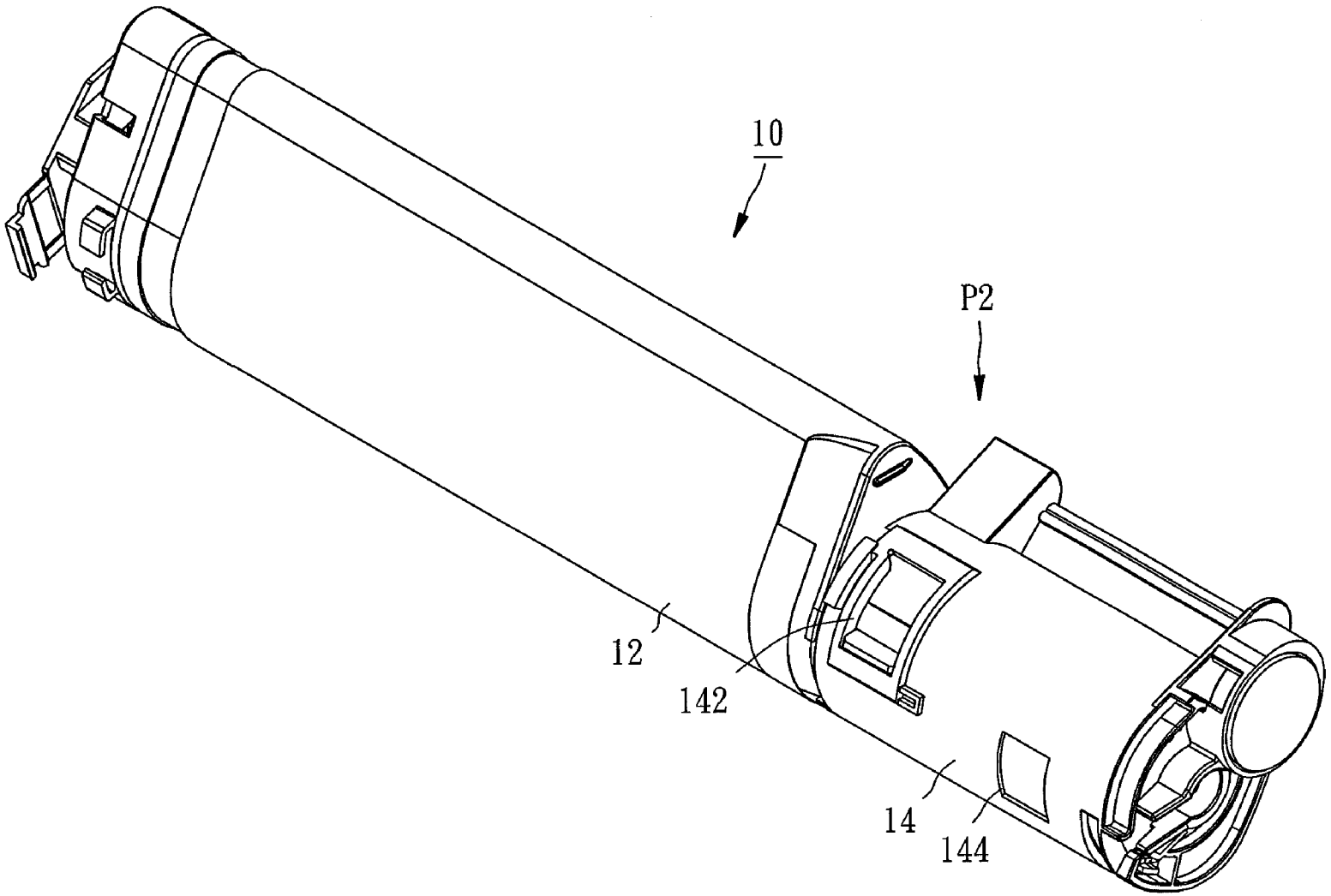
FIG. 1 PRIOR ART
FIG. 1 is a perspective view of a toner cartridge according to a prior art.
Figure 2:
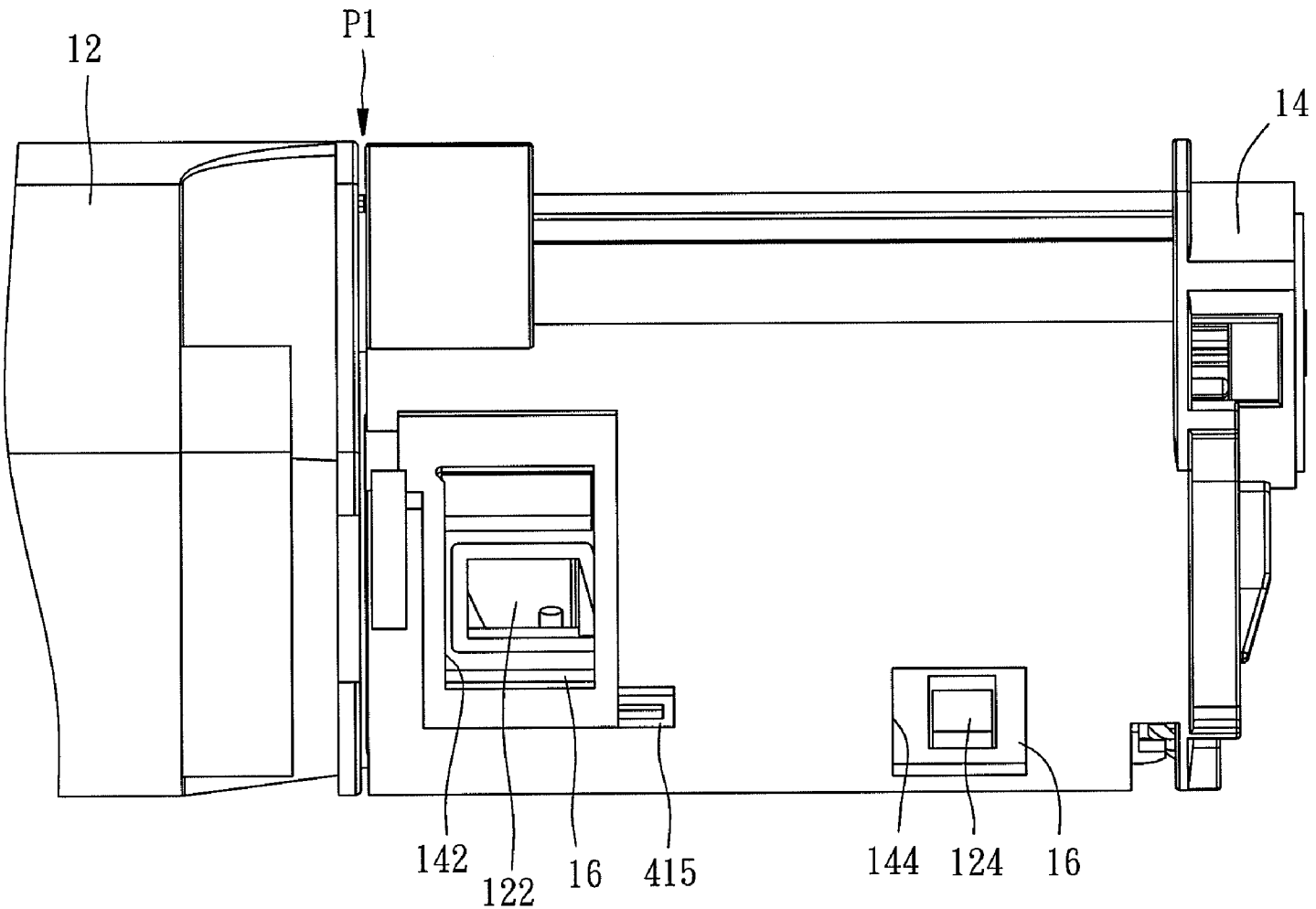
FIG. 2 PRIOR ART
FIG. 2 is a side view of the toner cartridge of the prior art.
Figure 3:
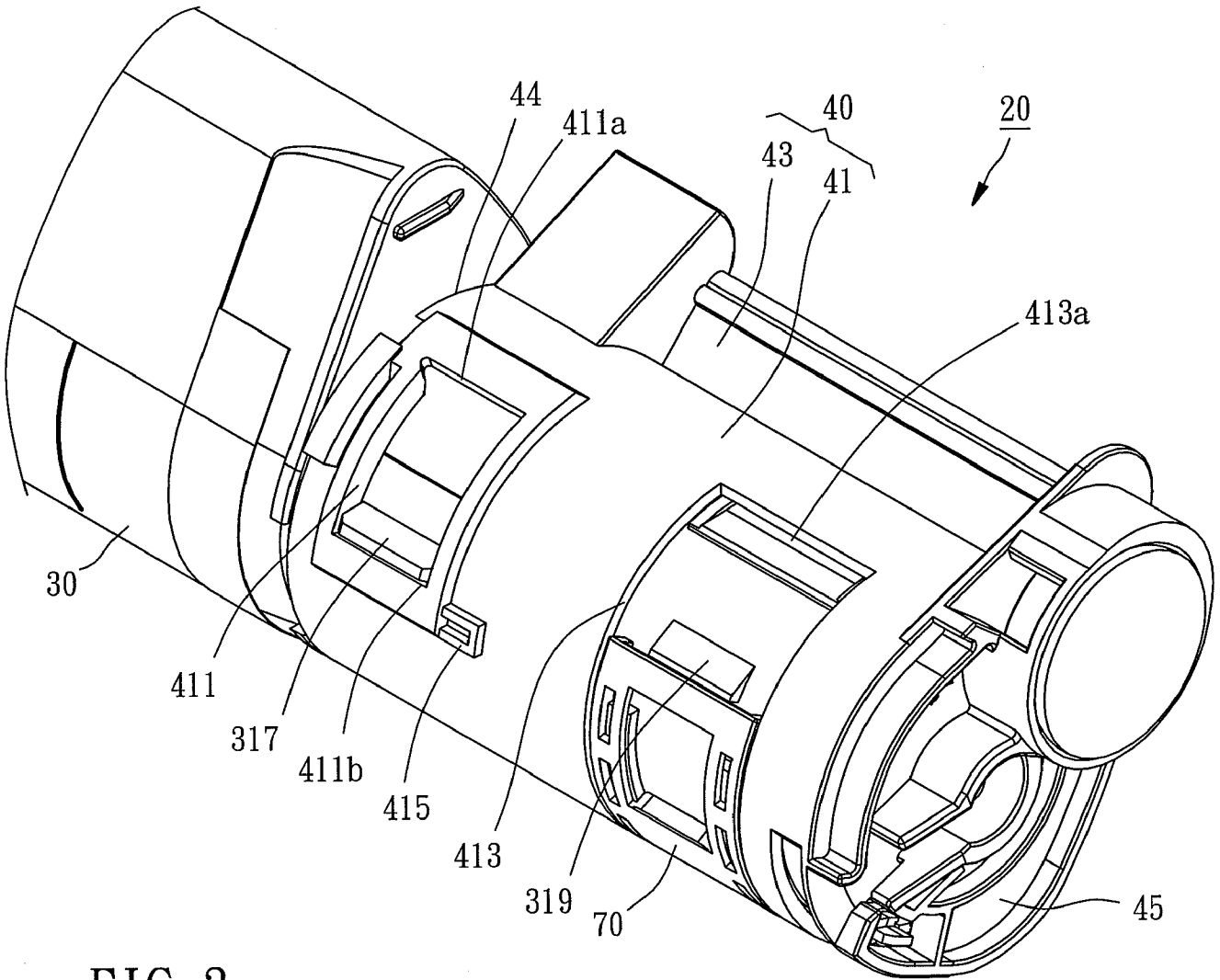
FIG. 3 is a perspective view of a toner cartridge according to a preferred embodiment of the present invention, showing that the rotator is located at the first position.
Figure 4:
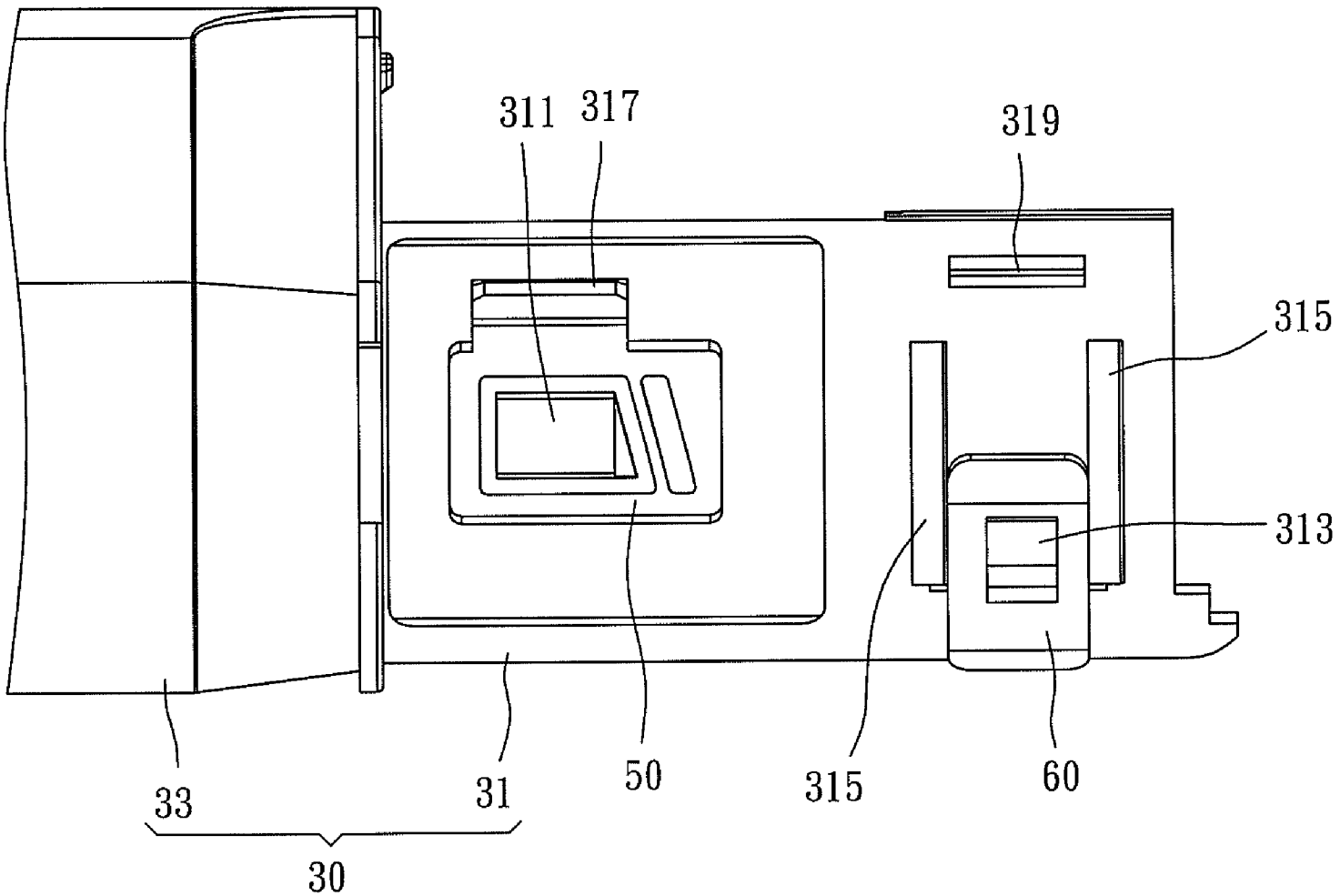
FIG. 4 is a side view of the toner cartridge according to the preferred embodiment of the present invention, in which the rotator is removed for showing a part of the housing and the first and second pads.

As shown in FIGS. 3 to 4, a toner cartridge 20 in accordance with a preferred embodiment of the present invention comprises a hollow housing 30, a rotator 40, a first pad 50, a second pad 60 and a sliding cover 70.

In this embodiment, the hollow housing 30 is made by plastic injection molding for accommodation of toner (not shown) therein. The housing 30 has a head 31 and a body 33 integrally connected with the head 31. Besides, as shown in FIG. 4, the head 31 is provided with a first mouth 311 adjacent to the body 33, and a second mouth 313 disposed spacedly from the first mouth 311 and far away from the body 33. The first mouth 311 and the second mouth 313 are served as a toner outlet and a toner recycling inlet respectively, or vice versa.

Figure 6:
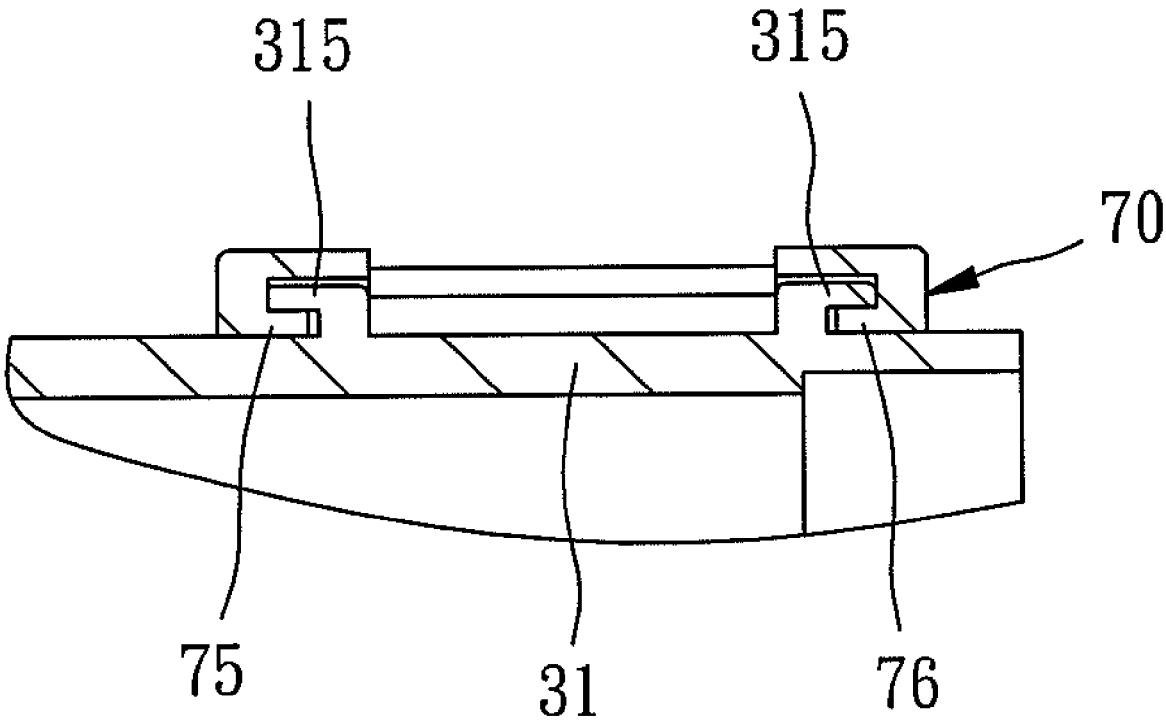
FIG. 6 is a sectional view taken along line 6-6 of FIG. 5A.

Referring to FIGS. 4 and 6, the head 31 is provided with two tracks 315, which have an inverted L-shaped cross section, at both sides of the second mouth 313. Further, the head 31 is provided with a protruded rotator stopper 317 adjacent to the first mouth 311 and a protruded cover stopper 319 located at a place corresponding to the space between the two tracks 315.

The rotator 40 is made by plastic injection molding. The rotator 40 has a cylinder-like body 41 and an actuation portion 43 integrally connected with the body 41. Besides, as shown in FIG. 3, the body 41 is provided with a first opening 411 and a second opening 413 disposed spacedly from the first opening 411 and larger in size than the first opening 411. Further, the rotator 40 has an open end 44 and a closed end 45 adjacent to the first opening 411 and the second opening 413 respectively. The inner wall of the rotator 40 has a draft taper increasing gradually from the closed end 45 to the open end 44 since the rotator 40 is made by plastic injection molding. On the other hand, as revealed in FIGS. 3 and 5A, the first opening 411 and the second opening 413 are provided with a first side wall 411*a*, 413*a* and a second side wall 411*b*, 413*b* respectively. Further, the cylinder-like body 41 has a bump 415 adjacent to the first opening 411.

The first pad 50 and the second pad 60 are sponge pads. As will be appreciated, the first and second pads 50, 60 can be made of any material capable of making the first and second mouths 311, 313 to tightly fit over the toner inlet/outlet of an image forming apparatus (not shown) respectively. Besides, the first pad 50 is thicker than the second pad 60. In actual fabrication, as shown in FIG. 4, the first and second pads 50, 60 are disposed around the first and second mouths 311, 313 respectively, and the second pad 60 is located between the two tracks 315. By this way, the first and second pads 50, 60 may fit the actual space between the rotator 40 and the head 31 while the rotator 40 is mounted on the head 31, such that the first and second mouths 311, 313 may tightly fit over the toner inlet/outlet of an image forming apparatus (not shown) respectively, thereby preventing leak of toner. Furthermore, the pad isn't necessary to cover over the whole head 31, thus the use of pad can be saved.

Figure 5A:
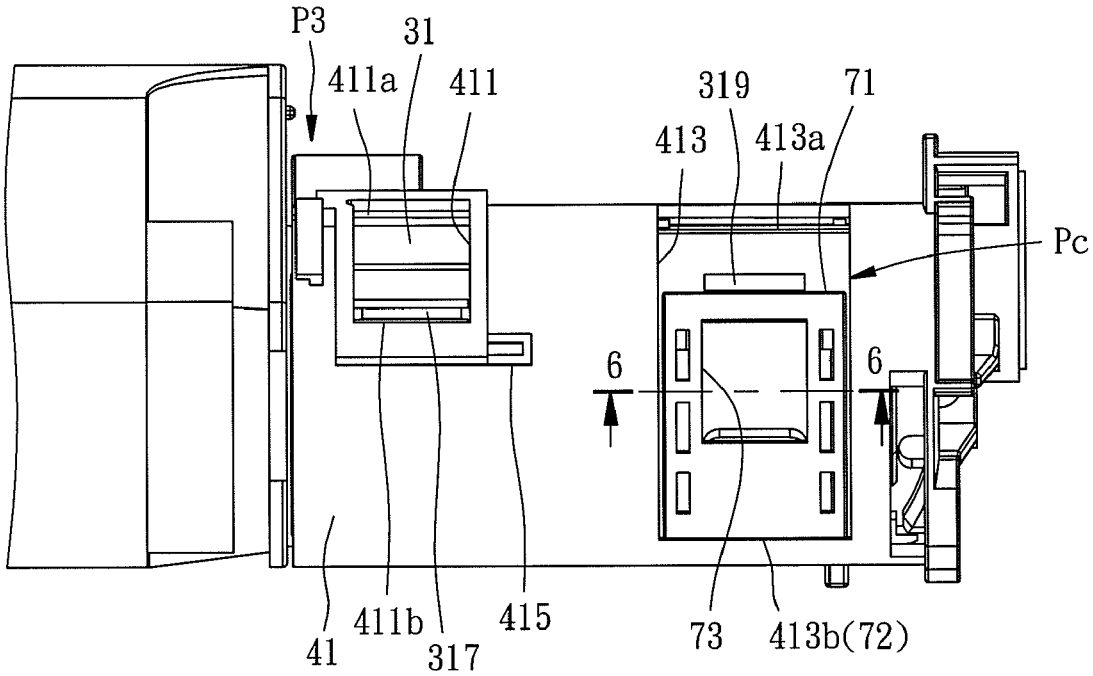
FIG. 5A is a side view of the toner cartridge according to the preferred embodiment of the present invention, showing that the rotator is located at the first position.
Figure 5B:
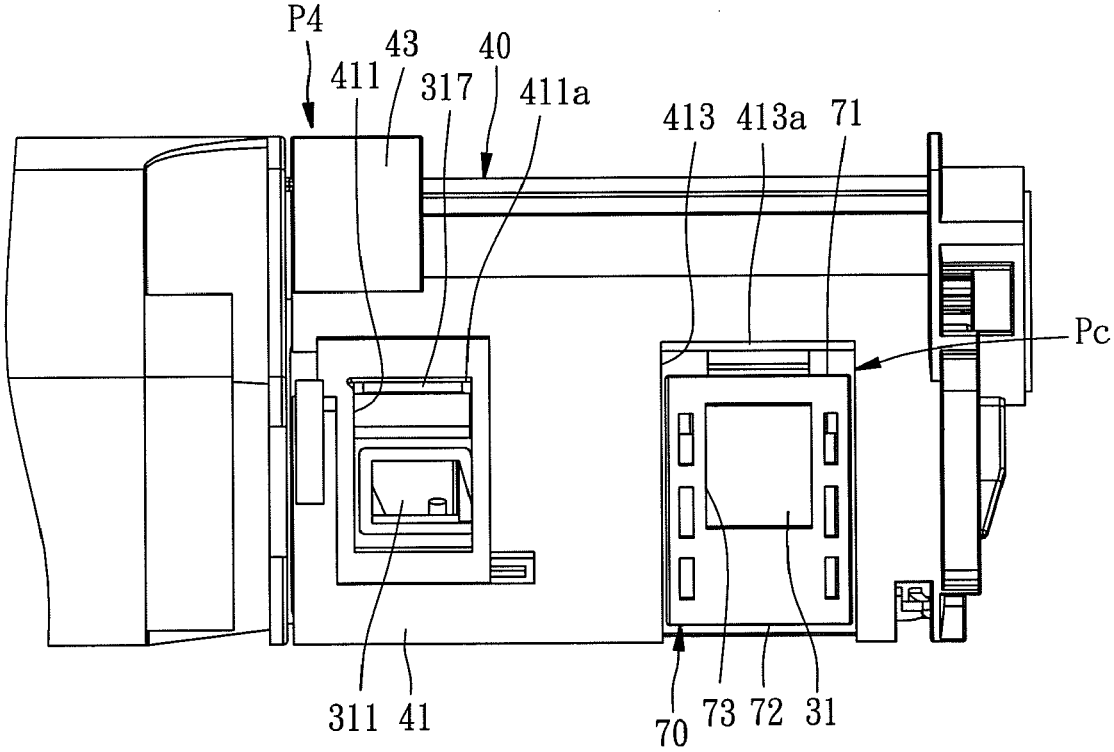
FIG. 5B is a side view of the toner cartridge according to the preferred embodiment of the present invention, showing that the rotator is located at the second position and the sliding cover is located at the closed position.
Figure 5C:
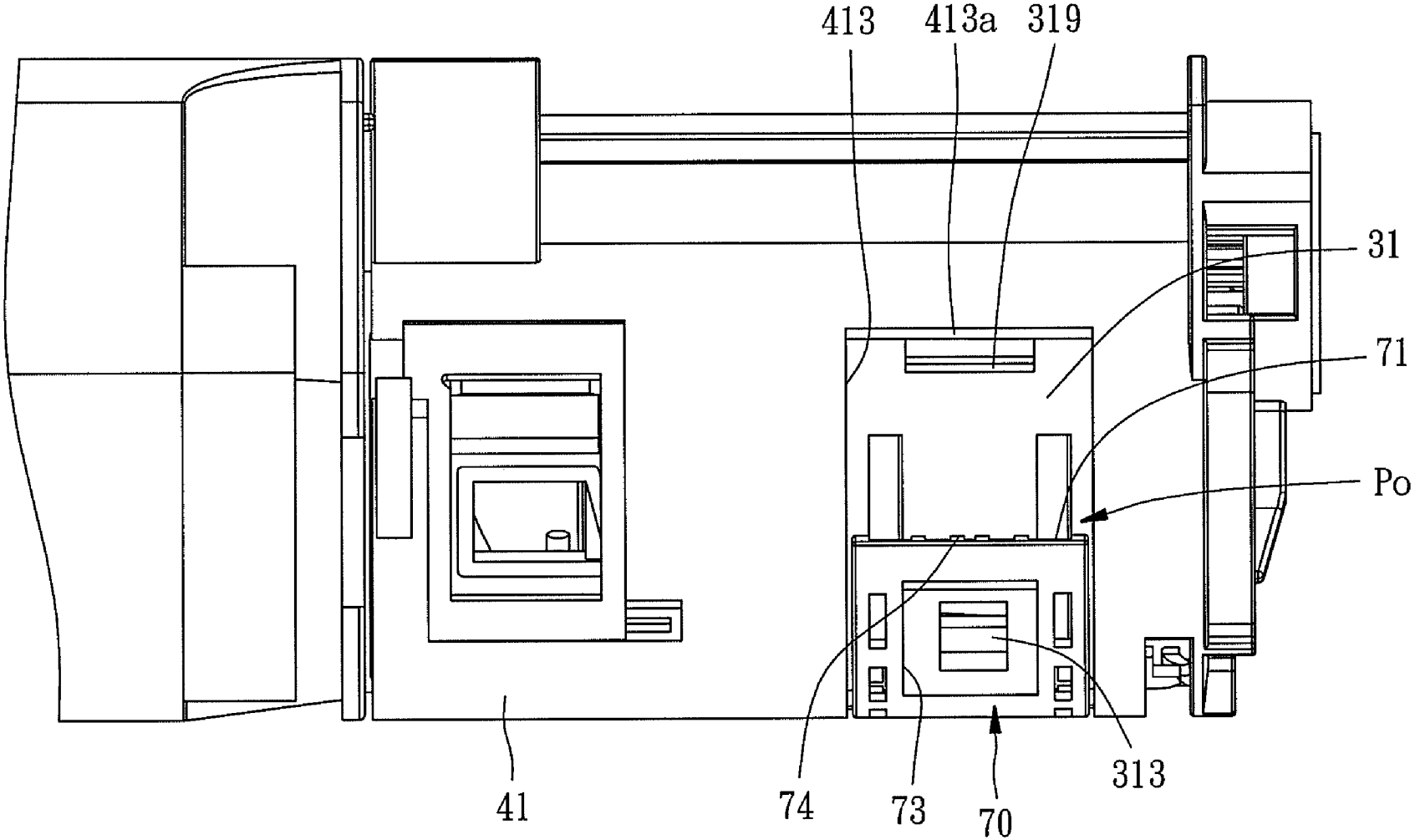
FIG. 5C is a side view of the toner cartridge according to the preferred embodiment of the present invention, showing that the rotator is located at the second position and the sliding cover is located at the open position.

The sliding cover 70 is made by plastic injection molding. As shown in FIGS. 5A to 5C, the sliding cover 70 has a first end portion 71 and a second end portion 72 opposite to the first end portion 71. The sliding cover 70 includes a rectangular through hole 73 adjacent to the first end portion 71, and a plurality of protrusions 74 integrally protruding from the first end portion 71. Further, as shown in FIG. 6, the sliding cover 70 is provided with two ribs 75, 76 extending downward and inward from the left and right side edges respectively.

In assembly, as stated above and as shown in FIG. 3, the first and second pads 50, 60 are disposed around the first and second mouths 311, 313 respectively, and the rotator 40 is mounted on and covers the head 31, such that the rotator 40 is rotatable relative to the head 31 between a first position P3 as shown in FIG. 5A, and a second position P4 as shown in FIG. 5B. Besides, as shown in FIGS. 5A to 5C and FIG. 6, the two ribs 75, 76 of the sliding cover 70 received in the second opening 413 are slidably engaged in the two tracks 315 respectively, such that the sliding cover 70 is slidable relative to the head 31 between a closed position Pc and an open position Po, as shown in FIG. 5C. Further, the rotator stopper 317 protrudes into and out of the first opening 411 of the rotator 40.

The features and operation of the toner cartridge 20 provided by the present invention are detailedly described hereinafter.

When the toner cartridge 20 of the present invention isn't installed in an image forming apparatus (not shown), as shown in FIG. 5A, the rotator 40 is located at the first position P3 in a normal condition. More specifically speaking, the rotator stopper 317 of the head 31 of the housing 30 is abutted against the second side wall 411*b* of the first opening 411 of the rotator, such that the first opening 411 and the first mouth 311 are staggered to each other, that is, the first mouth 311 is closed by the rotator 40. At the same time, the protrusions 74 of the sliding cover 70 are abutted against the cover stopper 319 and the second end portion 72 of the sliding cover 70 is abutted against the second side wall 413*b*, such that the sliding cover 70 is held at the closed position Pc to close the second mouth 313. As a result, when the toner cartridge 20 isn't installed in an image forming apparatus, the first and second mouths 311, 313 are closed, thereby preventing the leakage of toner accommodated inside the housing 30.

On the other hand, when the rotator 40, which is located at a normal, first position P3 as shown in FIG. 5A, is forced to rotate relative to the head 31 to the second position P4 as shown in FIG. 5B due to a user's erroneous operation, the first mouth 311 is now exposed and accessible through the first opening 411 of the body 41. At this time, the sliding cover 70 will be still stayed at the closed position Pc to close the second mouth 313. Thus, the toner may only leak out from the first mouth 311 other than from the first and second mouths 311, 313 at the same time, thereby reducing the leakage of the toner.

Further, when the toner cartridge 20 of the present invention is installed in an image forming apparatus (not shown), the action of installing the toner cartridge 20 will drive the actuation portion 43 of the rotator 40 to force the rotator 40 to rotate relative to the housing 30 from the first position P3 to the second position P4. During the installation process, the bump 415 of the rotator 40 will push a sliding member (not shown), which will be engaged with the sliding cover 70 in the installation process, of the image forming apparatus to rotate, such that the sliding member will lead the sliding cover 70 to move relative to the housing 30 from the closed position Pc to the open position Po. After the installation is completed, the rotator 40 is located at the second position P4, and the second end portion 72 of the sliding cover 70 is abutted against the second side wall 413*b* of the second opening 413 and stayed at the open position Po, such that the first and second mouths 311, 313 are accessible, as shown in FIG. 5C, for feeding and recycling toner, that is, the toner cartridge can work normally.

In other words, as shown in FIG. 5B, when the rotator 40 is located at the second position P4, or when the rotator 40 is in the process of rotation from the first position P3 to the second position P4, the sliding cover 70 will stay at the closed position Pc to close the second mouth 313 unless the sliding cover 70 is actuated by an external force to move toward the open position Po.

As stated above, when the toner cartridge of the present invention isn't installed in an image forming apparatus and the rotator is forced to rotate due to a user's erroneous operation, the sliding cover will normally stay at the closed position, such that the first and second mouths will not be exposed at the same time. As such, the toner may only leak out from the first mouth, thereby effectively reducing the leakage of the toner. Further, the first and second pads can fit the actual space between the rotator and the housing of the toner cartridge because they have different thickness, resulting in that the first and second mouths of the toner cartridge can tightly fit over the toner inlet/outlet of an image forming apparatus respectively, preventing the leakage of toner. Further, because the pads aren't necessary to cover over the whole head of the housing, the manufacturing cost can be reduced.

The invention being thus described, it will be obvious that the same may be varied in many ways. Such variations are not to be regarded as a departure from the spirit and scope of the invention, and all such modifications as would be obvious to one skilled in the art are intended to within the scope of the following claims.

What is claimed is:

1. A toner cartridge comprising:

a housing having a first mouth and a second mouth;

a rotator having a first opening and a second opening and being rotatably mounted on said housing in a manner that said rotator is rotatably moveable relative to said housing between a first position where said first mouth is closed by said rotator and said second mouth is accessible through said second opening, and a second position where said first mouth is accessible through said first opening and said second mouth is accessible through said second opening; and a sliding cover having a through hole and being slidably disposed on said housing in a manner that said sliding cover is received in said second opening of said rotator and slidably moveable relative to said housing between a closed position where said second mouth is closed by said sliding cover, and an open position where said second mouth is accessible through said through hole of said sliding cover and said second opening of said rotator;

wherein when said rotator is located at said first position, said sliding cover is stayed at said closed position; when said rotator is located at said second position, said sliding cover is moveable from said closed position to said open position by an external force.

2. The toner cartridge according to claim 1, wherein said housing has two tracks and said sliding cover has two ribs slidably engaged in said two tracks respectively.

3. The toner cartridge according to claim 1, wherein said housing has a cover stopper abutted against said sliding cover when said sliding cover is located at said closed position.

4. The toner cartridge according to claim 3, wherein said sliding cover is provided with a protrusion abutted against said cover stopper when said sliding cover is located at said closed position.

5. The toner cartridge according to claim 1, further comprising a first pad disposed around said first mouth and between said housing and said rotator, and a second pad, which is thinner in thickness than said first pad and disposed around said second mouth and between said housing and said rotator; wherein said rotator has an open end adjacent to said first opening and a closed end adjacent to said second opening.

6. The toner cartridge according to claim 1, wherein said housing has a rotator stopper adjacent to said first mouth and extending into said first opening.

* * * * *